US008783073B1

(12) United States Patent
Derman

(10) Patent No.: US 8,783,073 B1
(45) Date of Patent: Jul. 22, 2014

(54) APPARATUS FOR SECURING A PORTABLE ELECTRONIC DEVICE

(76) Inventor: Jay S. Derman, Torrance, CA (US)

( * ) Notice: Subject to any disclaimer, the term of this patent is extended or adjusted under 35 U.S.C. 154(b) by 158 days.

(21) Appl. No.: 13/466,633

(22) Filed: May 8, 2012

Related U.S. Application Data

(60) Provisional application No. 61/620,036, filed on Apr. 4, 2012.

(51) Int. Cl.
*E05B 73/00* (2006.01)

(52) U.S. Cl.
USPC ..... 70/14; 70/57; 70/58; 70/209; 248/551

(58) Field of Classification Search
USPC ..... 70/14, 57, 58, 209; 248/551–553
See application file for complete search history.

(56) References Cited

U.S. PATENT DOCUMENTS

| | | | | |
|---|---|---|---|---|
| 5,203,597 | A * | 4/1993 | Wheelock | 292/258 |
| 5,209,533 | A * | 5/1993 | Menard | 292/288 |
| 5,992,187 | A | 11/1999 | Derman | |
| 6,081,974 | A | 7/2000 | McDaid | |
| 6,159,025 | A | 12/2000 | Derman | |
| 6,317,936 | B1 | 11/2001 | McDaid | |
| 6,360,405 | B1 | 3/2002 | McDaid | |
| 6,510,718 | B1 * | 1/2003 | Chang | 70/209 |
| 6,553,797 | B2 * | 4/2003 | Witchey | 70/209 |
| 6,672,115 | B2 | 1/2004 | Wyers | |
| 6,725,695 | B2 * | 4/2004 | Vito | 70/209 |
| 6,793,081 | B1 | 9/2004 | Derman | |
| 7,028,513 | B2 * | 4/2006 | Avganim | 70/18 |
| 7,165,426 | B2 | 1/2007 | Wyers | |
| 7,174,752 | B2 * | 2/2007 | Galant | 70/58 |
| 7,225,649 | B2 | 6/2007 | Wyers | |
| 7,324,333 | B2 * | 1/2008 | Allen | 361/679.55 |
| 7,377,135 | B2 * | 5/2008 | Copus | 70/14 |
| 7,431,322 | B1 * | 10/2008 | Malak | 280/617 |
| 7,443,665 | B2 * | 10/2008 | Allen | 361/679.55 |
| 7,997,106 | B2 | 8/2011 | Mahaffey et al. | |
| 8,001,812 | B2 | 8/2011 | Mahaffey et al. | |
| D646,951 | S | 10/2011 | Tsai | |
| 8,061,164 | B2 * | 11/2011 | Johnston et al. | 70/58 |
| 8,191,851 | B2 * | 6/2012 | Crown | 248/553 |
| 8,210,007 | B1 * | 7/2012 | Laracy | 70/226 |
| 8,215,140 | B1 * | 7/2012 | Gaines | 70/14 |
| 8,596,099 | B1 * | 12/2013 | Eldred | 70/18 |

(Continued)

OTHER PUBLICATIONS

Reese Towpower 7006000 Stainless Steel Dual Bent Pin Receiver Lock, http://www.amazon.com, pp. 1-5, accessed Aug. 31, 2011.

*Primary Examiner* — Suzanne Barrett
(74) *Attorney, Agent, or Firm* — Aaron P. McGushion

(57) ABSTRACT

A system for securing an item is disclosed. The system may include a securement device and a lock. The securement device may include an elongated member having a first end and an opposite, second end. The securement device may further include first and second brackets. A first bracket may engage the first end of the elongated member and extend to engage or bracket a first portion of the perimeter of the item. A second bracket may selectively occupy a locked position with respect to the second end of the elongated member and extend to engage or bracket a second portion of the perimeter of the item. At least one of the first and second brackets may comprise an extension engaging the item and resisting side-to-side motion between the securement device and the item. The lock may engage the second end of the elongated member and hold the second bracket in the locked position.

16 Claims, 6 Drawing Sheets

(56) References Cited

U.S. PATENT DOCUMENTS

| | | | | |
|---|---|---|---|---|
| 2001/0032485 | A1* | 10/2001 | Wu | 70/209 |
| 2001/0038062 | A1* | 11/2001 | Galant | 248/551 |
| 2002/0104336 | A1* | 8/2002 | Witchey | 70/14 |
| 2002/0157431 | A1* | 10/2002 | Lurie et al. | 70/58 |
| 2005/0076684 | A1* | 4/2005 | Bistline | 70/58 |
| 2008/0196454 | A1* | 8/2008 | Frantz | 70/14 |
| 2011/0061427 | A1 | 3/2011 | Mahaffey et al. | |
| 2011/0080137 | A1* | 4/2011 | Avganim | 320/115 |
| 2011/0089794 | A1 | 4/2011 | Mahaffey et al. | |
| 2011/0185776 | A1* | 8/2011 | Mahaffey et al. | 70/58 |
| 2012/0234055 | A1* | 9/2012 | Bland et al. | 70/15 |
| 2012/0272693 | A1* | 11/2012 | Allen | 70/58 |

* cited by examiner

APPARATUS FOR SECURING A PORTABLE ELECTRONIC DEVICE

RELATED APPLICATIONS

This application claims the benefit of U.S. Provisional Patent Application Ser. No. 61/620,036 filed Apr. 4, 2012, which is hereby incorporated by reference.

BACKGROUND

1. The Field of the Invention

This invention relates to security systems and, more particularly, to novel systems and methods for securing personal property.

2. The Background Art

As computers, expensive electronic equipment, and other valuable portable articles have become more common, theft of such articles has increased. There are a number of different devices on the market to deter such theft. However, most of these devices are not well suited to many modern electronics that are relatively small and thin and lack built-in securement mechanisms. Accordingly, what is needed is an improved system and method for securing valuable portable articles.

BRIEF SUMMARY OF THE INVENTION

In view of the foregoing, in accordance with the invention as embodied and broadly described herein, a method and apparatus are disclosed in one embodiment of the present invention as including a system protecting an item from theft, unwanted removal, unauthorized use, or the like. In selected embodiments, a system may include a securement device and a lock. A securement device may include an elongated member, a first bracket, and a second bracket. A first bracket may connect to a first end of an elongated member and extend to engage or bracket a first portion of the perimeter of a corresponding item. A second bracket may selectively connect to a second end of the elongated member and extend to engage or bracket a second (e.g., opposite) portion of the perimeter. A lock (e.g., a lock marketed under the CLICKSAFE trademark by Kensington Computer Products Group) may then engage the second end of the elongated member and hold the second bracket in engagement with the item.

In selected embodiments, a system may include a tether. A tether may complete a link between an item and some anchor. For example, a tether may secure to a lock and extend therefrom to engage an anchor (e.g., a post, desk, table, or the like). Alternatively, a tether may be omitted. That is, a user may simply desire to maintain an item in a compacted, closed, or unusable configuration. In such embodiments, both a tether and an anchor may be omitted.

First and second brackets may engage an item in any suitable manner. In selected embodiments, one or more brackets may include one or more extensions extending to contain or block certain motion between a bracket and an item. For example, a bracket may include a top extension, bottom extension, and back portion collectively forming or defining a cavity for receiving an edge or other portion of an item therewithin. A cavity may be sized and shaped to closely track or follow the contours of a corresponding edge or portion of an item. Alternatively, a cavity may have a more generic shape that properly receives or engages an edge or portion of an item, but does not match the exact shape thereof.

In selected embodiments, a first bracket may be fixed with respect to an elongated member, while a second bracket may selectively move through a range of motion with respect to the elongated member. By increasing the distance between the first and second brackets, a securement device may be opened to receive an item therewithin. Conversely, by advancing the second bracket along the elongated member toward the first bracket, a securement device may be closed and an item may be engaged or gripped therewithin. A lock may then be applied to secure the second bracket in a locked position, thereby limiting the ability of an unauthorized user to remove the securement device from the item.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
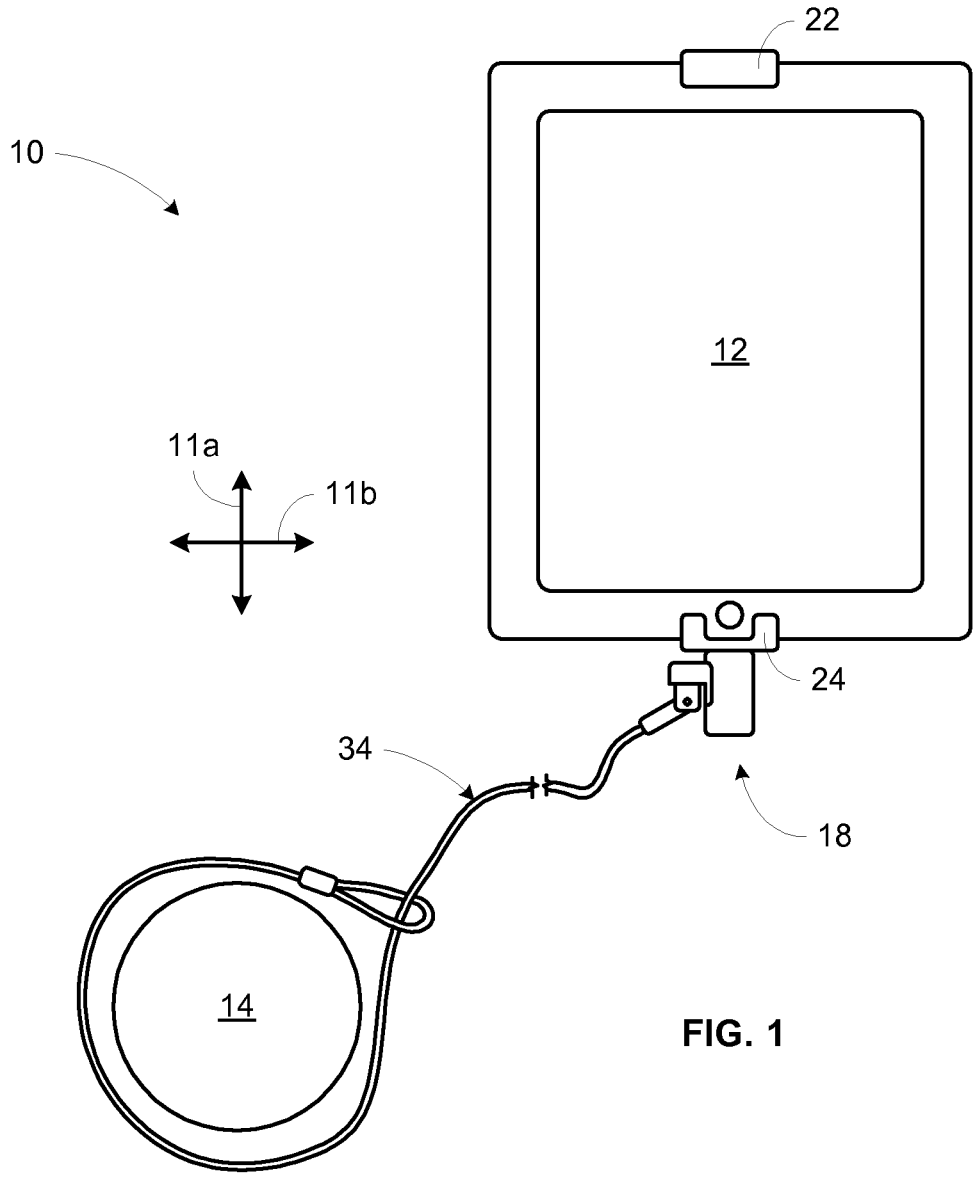
FIG. 1 is a top view of one embodiment of a system for engaging an item and tethering the item to an anchor in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Figure 2:
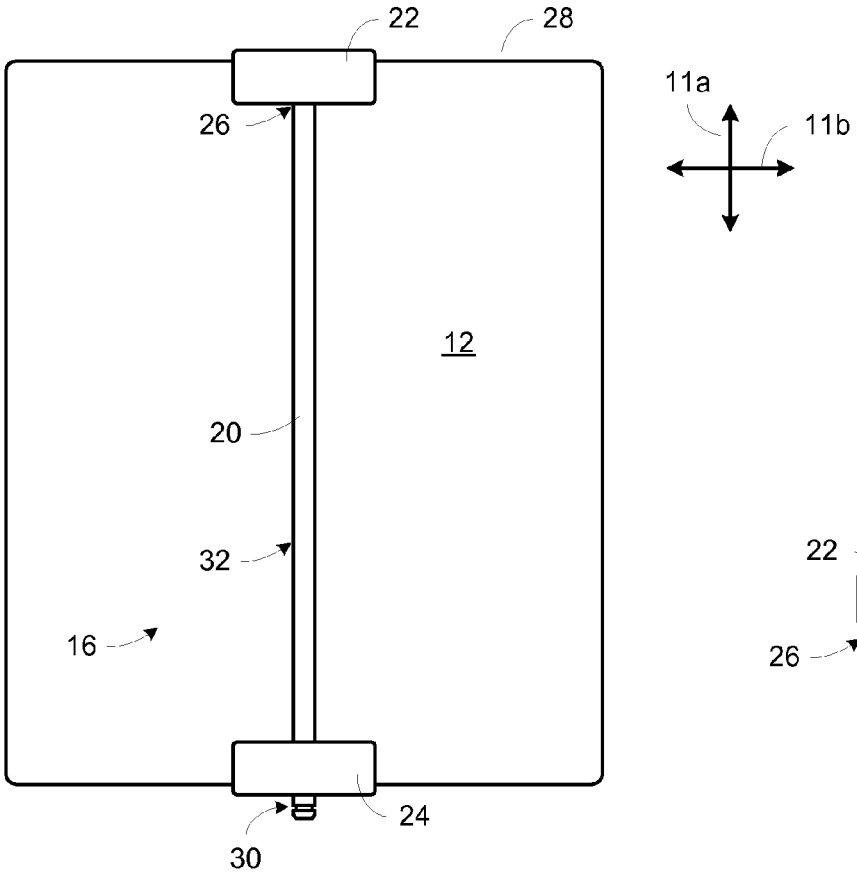
FIG. 2 is a bottom view of the securement device and item of FIG. 1.
Figure 3:
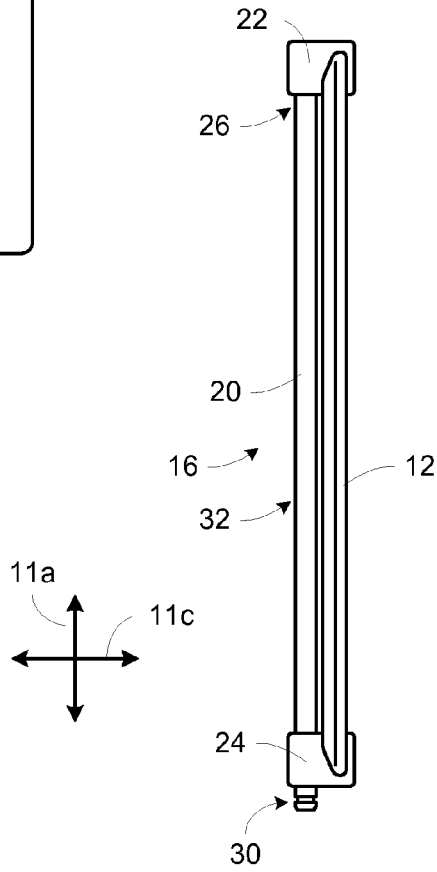
FIG. 3 is a side view of the securement device and item of FIG. 1.

Referring to FIGS. 1-3, in discussing a system 10 in accordance with the present invention, it may be helpful to first establish a coordinate system. Accordingly, in certain embodiments, a system 10, or one or more components thereof, may be described in terms of a three-dimensional coordinate system comprising longitudinal 11*a*, lateral 11*b*, and transverse 11*c* directions.

A system 10 in accordance with the present invention may protect an item 12 (e.g., valuable portable article, computer monitor, laptop computer, touch-screen tablet, cellular telephone, or the like) from theft, unwanted removal, unauthorized use, or the like. This may be accomplished by binding or securing an item 12 in a manner that resists use or removal of the item 12 (e.g., securing a laptop in a closed configuration, etc.). Alternatively, or in addition thereto, a system 10 may protect an item 12 by tethering or otherwise connecting an item 12 to an anchor 14.

An anchor 14 may be an object that is substantially fixed in place (e.g., an embedded post or the like). Alternatively an anchor 14 may be an object sufficiently heavy, bulky, or both to rendering moving the object unpractical or undesirable. For example, an anchor 14 may comprise a desk, table, or the like that may be moved or dismembered, but only with significant effort or with the generation of unwanted attention from surrounding individuals.

In selected embodiments, a system 10 in accordance with the present invention may include a securement device 16 and a lock 18. A securement device 16 may include one or more mechanisms for contacting and engaging (e.g., securing, holding, bracketing) an item 12. A lock 18 may engage a securement device 16 to maintain a secure connection between the securement device 16 and the corresponding item 12.

For example, in certain embodiments, a securement device 16 may include an elongated member 20, a first bracket 22, and a second bracket 24. A first bracket 22 may fixedly connect to a first end 26 of an elongated member 20 and extend to engage or bracket a first portion of the perimeter 28 of a corresponding item 12. A second bracket 24 may movably connect to a second end 30 of the elongated member 20 and extend to engage or bracket a second (e.g., opposite) portion of the perimeter 26. A lock 18 may then engage the second end 30 of the elongated member 20 and hold the second bracket 24 in engagement with the item 12.

An elongated member 20 may be substantially inextensible. That is, stretching or elongation of an elongated member 20 may only be accomplished with significant force (e.g., more force than can be applied by hand, without the aid of tools). Accordingly, once a securement device 16 is applied to an item 12, and a lock 18 is applied to the securement device 16, then first and second brackets 22, 24 may be properly spaced to secured an item 12 therebetween.

In selected embodiments, an elongated member 20 may be flexible. For example, an elongated member 20 may be formed of or comprise a section of chain, cable formed of stands of metal wire, or the like. Alternatively, or in addition thereto, an elongated member 20 may be formed of or comprise one or more sections of substantially rigid material. For example, one or more ends (e.g., a second end 30) of an elongated member 20 may be formed of rigid material (e.g., cylindrical material or the like), while an intermediate portion 32 may comprise something flexible (e.g., chain, cable, or the like). In still other embodiments, an entire elongated member 20 may be formed of rigid material. For example, an elongated member 20 may comprise a rod (e.g., a round or polygonal cylinder, bar, or the like) of material, flat strip of material, or the like.

When applied to an item 12, an elongated member 20 may have any suitable orientation. For example, selected items 12 (e.g., cellular telephones, tablet computers, laptop computers, etc.) may be generally rectangular in shape and have a length extending in the longitudinal direction 11*a* and a width extending in the lateral direction 11*b*. For such items 12, an elongated member 20 may extend in the longitudinal direction 11*a*, while the first and second brackets 22, 24 engage or bracket the top and bottom ends or edges of the item 12. Alternatively, the elongated member 20 may extend in the lateral direction 11*b*, while the first and second brackets 22, 24 engage or bracket the left and right sides or edges of the item 12.

An elongated member 20 may have any suitable shape. For example, selected items 12 (e.g., cellular telephones, tablet computers, laptop computers, etc.) may be generally thin and flat. For such items 12, an elongated member 20 may be extend in a line from a first bracket 22 to a second bracket 24. Alternatively, an elongated member 20 may curve or extend in a manner that is not straight. Such shapes may be included for aesthetics, to accommodate or follow the shape of an item 12, or some combination thereof.

In selected embodiments, a system 10 may include a tether 34. A tether 34 may complete a link between an item 12 and an anchor 14. A tether 34 may comprise chain, cable, or the like. In selected embodiments, a tether 34 may secure to a lock 34 (e.g., engage or loop through or around a shackle of a lock 18) and extend therefrom to engage (e.g., loop through or around) an anchor 14.

A lock 18 in accordance the present invention may have any suitable form. The form of the lock 18 may vary depending on the configuration of a securement device 16 or components thereof. In certain embodiments, a lock 18 or a lock 18 and tether 34 combination and may be configured as or comprise a device currently being sold by Kensington Computer Products Group under the CLICKSAFE trademark. In other embodiments, a lock 18 may comprise a padlock. In still other embodiments, a system 10 in accordance with the present invention may utilize other kinds of locks 18.

In certain embodiments, a tether 34 may be omitted. For example, in selected embodiments, a securement device 16 and lock 18 may be all the security necessary or desired. That is, a user may simply desire to maintain an item 12 in a compacted, closed, or unusable configuration, not to tether the item 12 to an anchor 14. In such embodiments, both a tether 34 and an anchor 14 may be omitted from a system 10 in accordance with the present invention.

The various components of a system 10 in accordance with the present invention may be formed of any suitable materials. Suitable materials may be selected to provide a desired durability, strength, rigidity, toughness, or the like. For example, in selected embodiments, one or more of the components of a system 10 may be formed of a polymeric material. However, in other embodiments where greater stresses are expected, such components may be formed of a metal or metal alloy.

One or more components 16, 18, 20, 22, 24, 34 of a system 10 may be coated or covered partially or completely with one or more protective materials (e.g., polymeric materials). Such materials may facilitate handling of the components, protect the components, prevent unwanted abrasion or damage of an item 12, or the like. Additionally, certain such materials may enable one or more brackets 22, 24 to better grip and secure an item 12.

Figure 4:
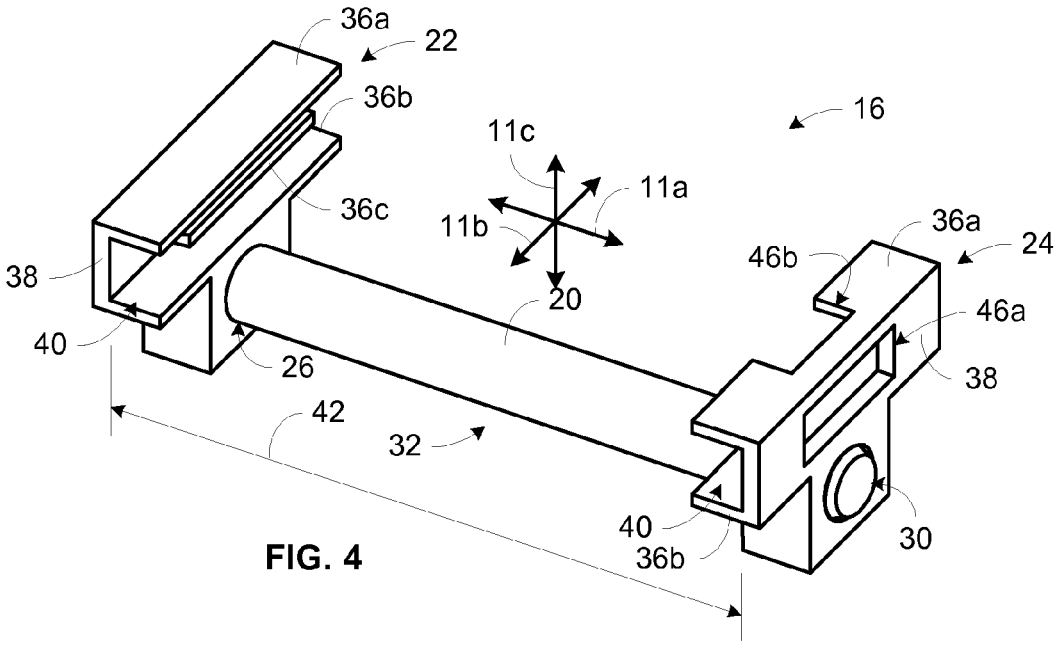
FIG. 4 is a perspective view of one embodiment of a securement device in an "open" configuration wherein the securement device is ready to receive an item therewithin in accordance with the present invention.
Figure 5:
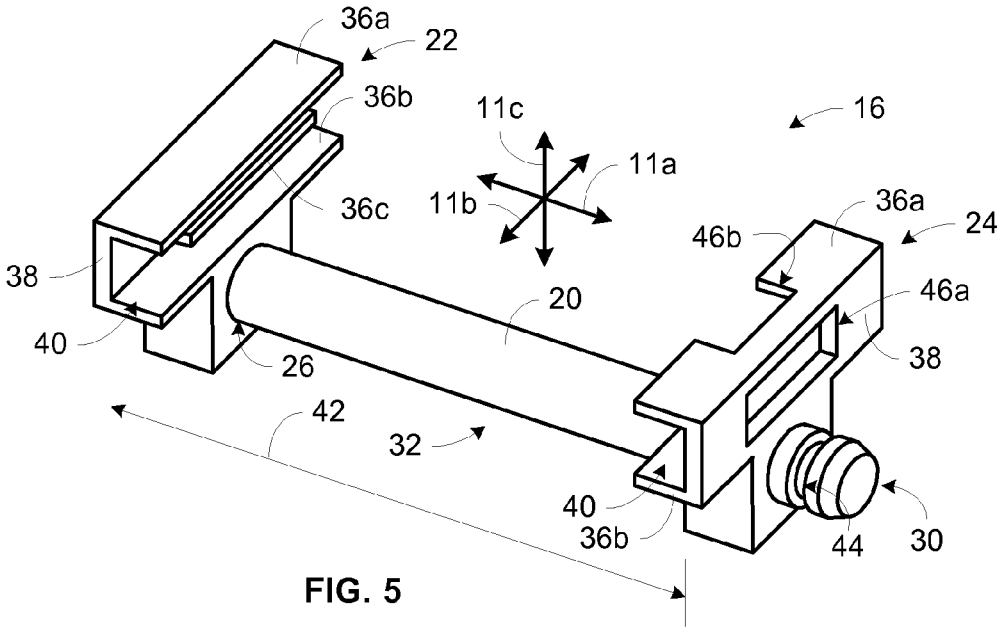
FIG. 5 is a perspective view of the securement device of FIG. 4 transitioned to a "closed" configuration wherein the securement device would engage an item had one been installed therewithin.

Referring to FIGS. 4 and 5, brackets 22, 24 in accordance with the present invention may engage an item 12 in any suitable manner. In general, a bracket 22, 24 may engage an item 12 and resist relative motion with respect thereto in the lateral and transverse 11*b*, 11*c* directions. Two brackets 22, 24, held together by an elongated member 20, may cooperate to resist relative motion with respect to an item 12 in the longitudinal directions 11*a*. Suitable engagement mechanisms between a bracket 22, 24 and an item 12 may include frictional engagement, mechanical interference, mechanical abutment, or the like or combinations or sub-combinations thereof.

First and second brackets 22, 24 may have any suitable size and shape. In selected embodiments, the shape and size may be selected to fit (or support engagement with) a particular item 12, a group of items 12 having similarly dimensions, certain accessories associated with an item 12 (e.g., protective covers), or the like. For example, one or more brackets 22, 24 may include one or more extensions 36 extending to contain or block certain motion between a bracket 22, 24 and an item 12.

In certain embodiments, a bracket 22, 24 may include a top extension 36*a*, a bottom extension 36*b*, or some combination thereof that extends to engage or bracket an edge or other portion of an item 12, thereby containing relative motion in the transverse direction 11*b*. For example, one or more brackets 22, 24 may include a top extension 36*a*, a bottom extension 36*b*, and back portion 38 collectively forming or defining a cavity 40 for receiving an edge or other portion of an item 12 therewithin.

A cavity 40 may be sized and shaped to closely track or follow the contours of a corresponding edge or portion of an item 12. Such tracking may be of the item 12 itself or of some protective sleeve, cover, or case placed over an item 12. Alternatively, a cavity 40 may have a more generic shape (e.g., a rectangular shape) that properly receives or engages an edge or portion of an item 12, but does not match the exact shape thereof.

Alternatively, or in addition thereto, a bracket 22, 24 may include an extension 36*c* extending to engage some aperture of an item 12. That is, an item 12 may have one or more apertures formed therein. For example, a tablet computer (e.g., IPAD), cellular telephone, or the like may have an aperture or receptacle for receiving the plug of a charger or USB cable, an aperture or "jack" for receiving the plug of an earpiece or headphone, or the like. Accordingly, an extension 36*c* may extend into such an aperture. This engagement may limit or resist relative motion between a bracket 22, 24 and an item 12 in the lateral and transverse directions 11*b*, 11*b*.

In selected embodiments, one bracket (e.g., a first bracket 22) may be fixed with respect to an elongated member 20, while another (e.g., a second bracket 24) may selectively move through a range of motion with respect to the elongated member 20. By adjusting or changing the position of a second bracket 24 with respect to an elongated member 20, a user may control a distance 42 between a first bracket 22 and the second bracket 24.

With no lock 18 secured in place, a second bracket 24 may be free to move to increase the distance 42 between the first and second brackets 24 (e.g., free to "open" the securement device 16). In an open configuration, a securement device 16 may receive an item 12 therewithin or be applied to an item 12. Once the item 12 is positioned between or within the first and second brackets 22, 24, the second bracket 24 may be advanced along the elongated member 20 toward the first bracket 22. Such "closing" motion may continue until the first and second bracket 22, 24 have fully engaged the item 12, at which time the second bracket 24 may be said to occupy an engaged or locked position. A lock 18 may then be applied to secure the second bracket 24 in the locked position, thereby limiting the ability of an unauthorized user to remove the securement device 16 from the item 12.

In certain embodiments, the length of an elongated member 20 and the engagement thereof by a lock 18 may be configured to hold first and second brackets 22, 24 firmly against an item 12. That is, in a locked position, the first and second brackets 22, 24 may apply a compressive force to an item 12. This may be helpful when a frictional engagement factors into the ability of the brackets 22, 24 to engage and secure an item 12. Alternatively, a lock 18 may simply block a securement device 16 from opening and not apply any compressive force to an item 12.

The length of an elongated member 20, the dimensions of the brackets 22, 24, the location at which a lock 18 engages a securement device 16, and the like may be selected and balanced to fit a particular item 12 or group of items 12. However, it certain embodiments, it may be desirable to finely adjust a securement device 16 to fit an item 12 in a particular way or to fit a variety of items 12 that vary in certain dimensions.

Accordingly, in selected embodiments, a securement device 16 may include one or more spacers (e.g., washers, collars, or the like) that may be positioned on or around an elongated member 20 between a second bracket 24 and a lock 18. By controlling the dimensions of such spacers, the distance 42 between first and second brackets 22, 24 in the locked position may be tailored to fit a particular application or item 12. In certain embodiments, one or more spacers may be elastomeric or spring-like and assist in removing unwanted rattle or play between a securement device 16 and an item 12 or in applying a desired compressive force to an item 12.

In selected embodiments, a second end 30 of an elongated member 12 may provide a mechanism through which a lock 18 may secure a second bracket 24 in an engaged or locked position. A second end 30 in accordance with the present invention may have any suitable configuration. In certain embodiments, a second end 30 may be configured as an anchor disclosed in U.S. Pat. No. 6,081,974 issued Jul. 4, 2000, U.S. Pat. No. 6,317,936 issued Nov. 20, 2001, or U.S. Pat. No. 6,360,405 issued Mar. 26, 2002, each of which is hereby incorporated by reference. Alternatively, a second end 30 may be configured as an attachment device disclosed in U.S. Pat. No. 7,997,106 issued Aug. 16, 2011 or U.S. Pat. No. 8,001,812 issued Aug. 23, 2011, both of which are hereby incorporated by reference. In still other embodiments, a second end 30 may be configured as or include an interface mechanism disclosed in U.S. patent application Ser. No. 13/216,076 filed Aug. 23, 2011, which is hereby incorporated by reference.

A second end 30 of an elongated member 20 may include one or more mechanisms or structures enabling a lock 18 to engage therewith. For example, a second end 30 may include a locking groove 44 enabling a lock 18 to selectively grip an elongated member 20. In certain embodiments, a locking groove 44 may extend circumferentially about a second end 30. Such a locking groove 44 may enable a lock 18 to pivot about the corresponding end 30, while maintaining a secure engagement therewith.

In certain embodiments, to engage a second end 30, a lock 18 may be configured as or comprise a device disclosed in U.S. Pat. No. 6,081,974, U.S. Pat. No. 6,317,936, U.S. Pat. No. 6,360,405, U.S. Pat. No. 7,997,106, or U.S. Pat. No. 8,001,812. For example, as stated hereinabove, a lock 18 or a lock 18 and tether 34 combination and may be configured as or comprise a device currently being sold by Kensington Computer Products Group under the CLICKSAFE trademark.

In selected embodiments, a lock 18 may operate in conjunction with or include one or more of the devices disclosed in U.S. patent application Ser. No. 13/270,439 filed Oct. 11, 2011, U.S. patent application Ser. No. 13/355,328 filed Jan. 20, 2012, U.S. patent application Ser. No. 13/438,147 filed Apr. 3, 2012, U.S. Pat. No. 5,992,187 issued Nov. 30, 1999, U.S. Pat. No. 6,159,025 issued Dec. 12, 2000, and U.S. Pat. No. 6,793,081 issued Sep. 21, 2004, each of which is hereby incorporated by reference.

A bracket 22, 24 in accordance with the present invention may include one or more openings 46 (e.g., apertures, slots, or the like). Such openings 46 may be strategically located to provide access to certain portions, ports, or controls of an item 12. For example, one opening 46*a* may provide access to a headphone jack, speaker, or the like, while another opening 46*b* may provide access to a button. Alternative, or in addition thereto, a bracket 22, 24 may block access to certain portions, ports, or controls of an item 12. For example, rather than having an opening 46*b* exposing a button, a bracket 22, 24 may have an extension blocking access to the button. Thus, when installed, a securement device 16 in accordance with the present invention may block certain uses or operations of an item 12.

Figure 6:
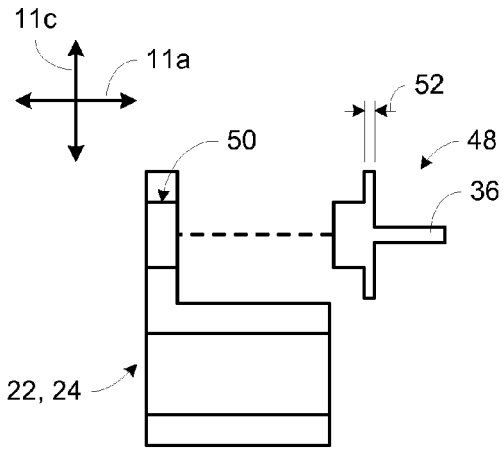
FIG. 6 is a cross-sectional, exploded view of one embodiment of a bracket and insert in accordance with the present invention.
Figure 7:
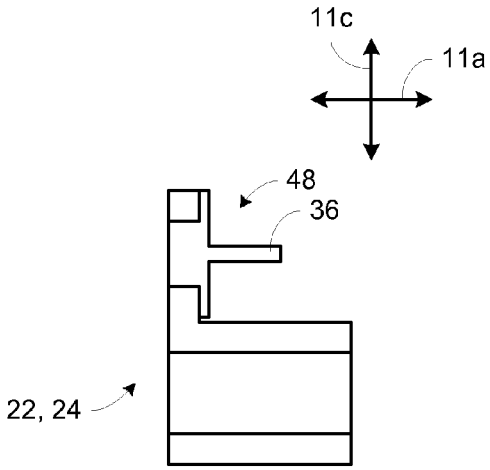
FIG. 7 is a cross-sectional, assembled view of the bracket and insert of FIG. 6.
Figure 8:
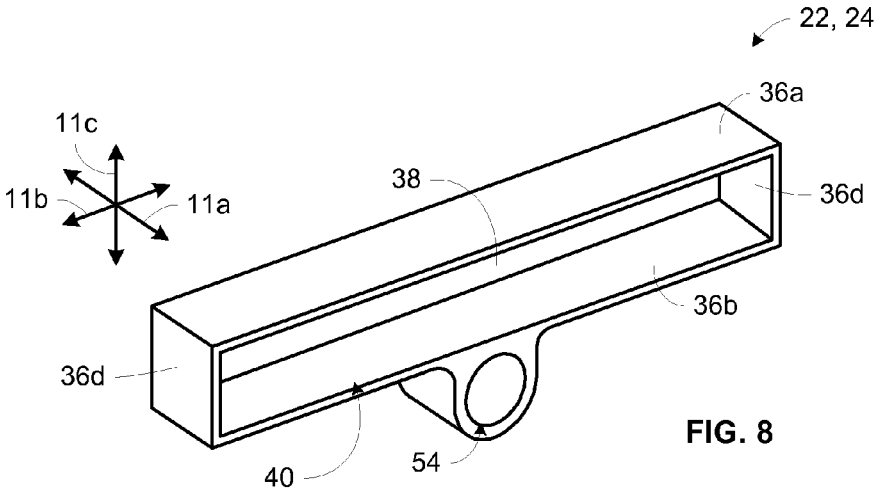
FIG. 8 is a perspective view of an alternative embodiment of a bracket in accordance with the present invention.
Figure 9:
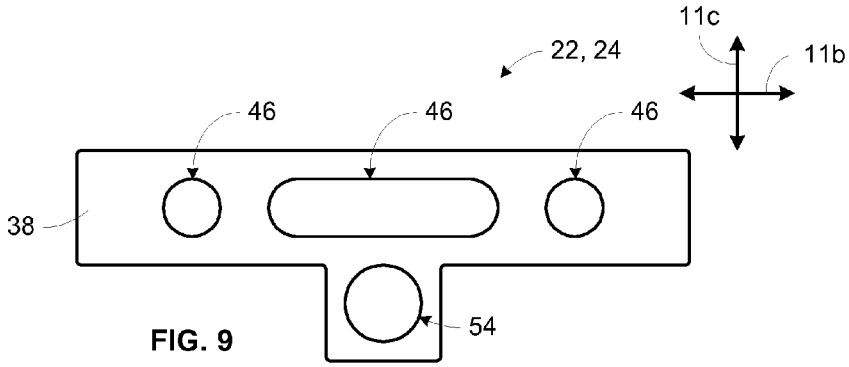
FIG. 9 is a back elevation view of an alternative embodiment of a bracket in accordance with the present invention.
Figure 10:
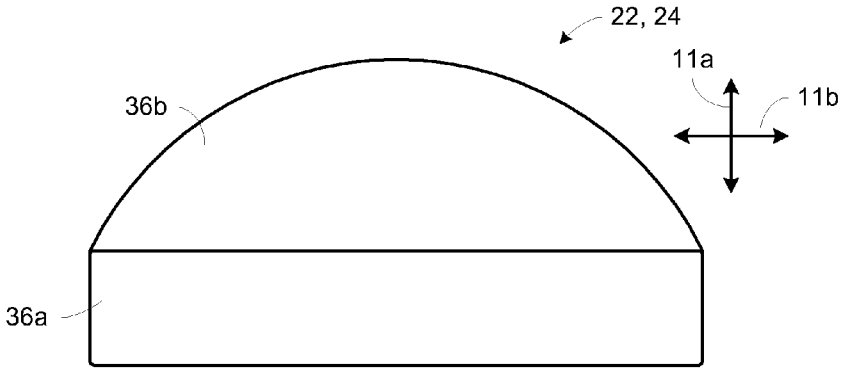
FIG. 10 is a top plan view of the bracket of FIG. 9.
Figure 11:
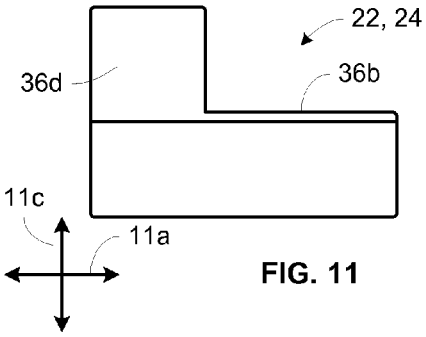
FIG. 11 is an elevation view showing a side extension that may be included within the bracket of FIG. 9.
Figure 12:
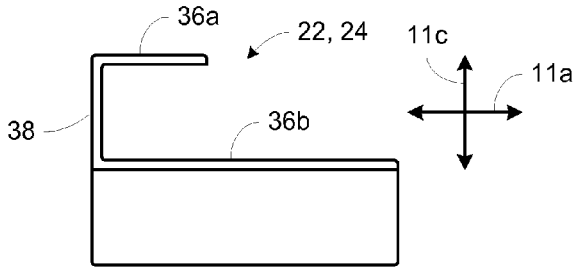
FIG. 12 is an elevation view showing the bracket of FIG. 9 without a side extension.
Figure 13:
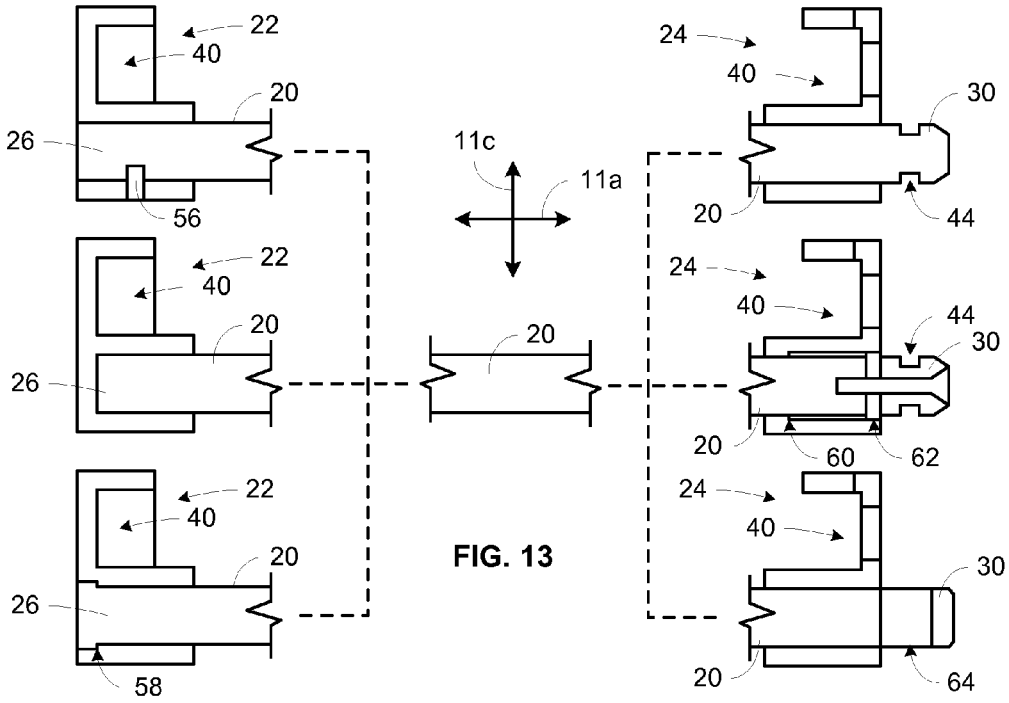
FIG. 13 is a cross-sectional view of various possible combinations of an elongated member and associated first and second brackets in accordance with the present invention.

Referring to FIGS. 6 and 7, in selected embodiments, one or more extensions 36 may be configured as or extend from a removable insert 48. For example, a bracket 22, 24 may include a registration aperture 50. An insert 48 may be removably seated within a registration aperture 50. One or more extensions 36 may then extend from the insert 48 to engage an item 12 or portion thereof. Different inserts 48 may have different dimensions, spacings 52, extensions 36, and the like. Thus, different inserts 48 may be used to adapt a particular bracket 22, 24 (e.g., a bracket 22, 24 of a particular design or configuration) to a variety of items 12.

In certain embodiments, an extension 36 (e.g., an extension 36 located on an insert 48) may form a plug configured to match and engage one or more USB, HDMI, microphone, audio, VGA, or LAN ports or the like. For example, an insert 48 may be configured as a "dummy" USB plug, having the dimensions, extensions, cavities, or the like thereof, but lacking the electrical connectivity of the actual plug.

Referring to FIGS. 8-13, in selected embodiments, a bracket 22, 24 may include one or more extensions 36 forming side walls 36*d*. Side walls 36*d* may abut one or more sides of an item 12 or the sides of something extending from an item 12. For example, in certain embodiments, a bracket 22, 24 may include a top extension 36*a*, bottom extension 36*b*, and opposing side walls 36*d* that collectively form a cavity 40 or pocket for receiving an entire edge or end of an item 12 (e.g., a top or bottom edge of an item 12). Alternatively, a top extension 36*a*, bottom extension 36*b*, and opposing side walls 36*d* may collectively form a smaller cavity 40 or pocket for receiving something extending from an item 12.

A bracket 22, 24 may receive or secure to an elongated member 20 in any suitable manner. Suitable methods of securement may include welding, riveting, pinning, bolting, threading, crimping, press fitting, monolithic formation (e.g., casting, molding, or machining an elongated member 20 and a bracket 22 as a single, seamless unit), or the like or some combination or sub-combination thereof.

In selected embodiments, a bracket 22, 24 may include an aperture 54 for receiving a portion of an elongated member 20. In certain embodiments, a first bracket 22 may include an aperture 54 for receiving a first end 26 of an elongated member 20. A first end 26 may be substantially fixed within such an aperture 54. For example, a pin 56 may be applied to secure a first end 26 within an aperture 54.

Extensions 36 in accordance with the present invention may have any suitable size and shape. For example, in selected embodiments, a bottom extension 36*b* have extend further than one or more other extension 36*a*, 36*d* and have one or more curved or semi-circular edges.

An aperture 54 may be formed as a through hole. Alternatively, an aperture 54 may be closed at one end to form a blind hole. In certain embodiments, a first end 26 of an elongated member 20 may include a shoulder 58 or head 58 sized and shaped to abut a corresponding shoulder of a corresponding first bracket 22. Such embodiments, may provide a one way securement (e.g., a first bracket 22 may move along an elongated member 20 toward a second bracket 24, but may not move off the first end 26). Alternatively, a shoulder 58 or head 58 may be utilized in a press fit embodiment, wherein substantially all relative motion between a first bracket 22 and an elongated member 20 is resisted.

In certain embodiments, a second bracket 24 may include an aperture 54 of sufficient size for the second bracket 24 to selectively slide along an elongated member 20. For example, an aperture 54 of a second bracket 24 may be sized to provide at least a slip fit with respect to a corresponding elongated member 20. A second bracket 24 may be free to slide on and off an elongated member 20. Alternatively, a second bracket 24, elongated member 20, or some combination thereof may provide a mechanism for containing or limiting the motion of a second bracket 24. For example, a second bracket 24 may include a shoulder 60 configured to abut against a corresponding shoulder 62 of an elongated member 20 to prevent the second bracket 24 from being removed therefrom. In selected embodiments, a shoulder 62 corresponding to an elongated member 20 may be selectively removable to enable assembly and disassembly of a securement device 16.

A second end 30 of an elongated member 20 need not include a locking groove 44. For example, in selected embodiments, a second end 30 may include a shackle aperture 64 rather than a locking groove 44. A shackle aperture 64 may be configured to receive the shackle of a lock 18 therewithin. Once a shackle has been inserted and secured within a shackle aperture 64, the shackle may resist certain movement of a second bracket 24. Thus, a second bracket 24 may be secured in a locked position by a pad lock or the like.

Figure 14:
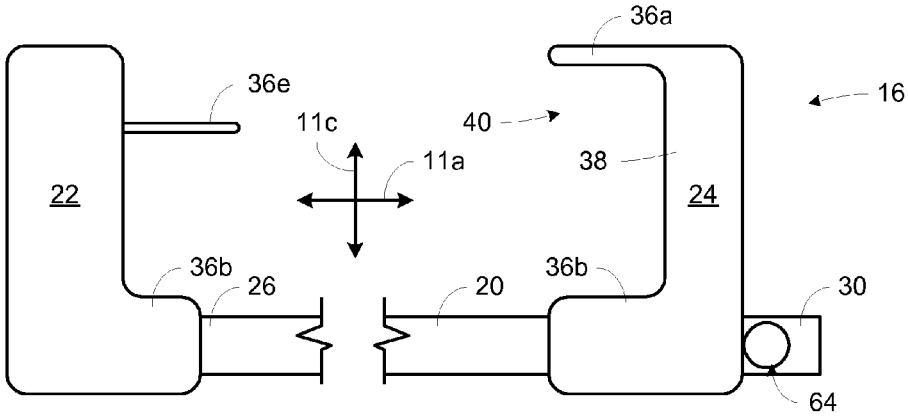
FIG. 14 is a side view of one embodiment of a securement device configured to engage a laptop computer in accordance with the present invention.

Referring to FIG. 14, in certain embodiments, a securement device 16 in accordance with the present invention may include an extension 36 formed or configured as a laptop centering device 36*e*. Such a device 36*e* may prevent a securement device 16 from sliding off an end of a laptop once it has been applied and secured with a lock 18.

A centering device 36*e* may have any suitable configuration. In selected embodiments, a laptop centering device 36*e* may extend between a screen and main body of a laptop at a location between the screen hinges. Once a centering device 36*e* is inserted in place and the securement device 16 is tightened and locked, the centering device 36*e* may prevent the securement device 16 from being slid off the laptop. That is, the hinges of the laptop may limit the side-to-side motion of the centering device 36*e* and the centering device 36*e* may, therefore, limit the side-to-side motion of the securement device 16.

In selected embodiments, a securement device 16 and lock 18 in accordance with the present invention may be used to secure a laptop computer in an open or closed position. In certain such embodiments, a securement device 16 or one or components thereof (e.g., brackets 22, 24) may include an extension 36 configured to engage one or more USB, HDMI, microphone, audio, VGA, or LAN ports or the like. Such ports may enable a securement device 16 (e.g., an elongated member 20) to extend in across the laptop computer in the longitudinal, lateral, or transverse directions 11*a*, 11*b*, 11*c*.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A securement device for securing an item, the item defining a perimeter, the perimeter having a first portion and a second portion, the item having at least one of a power aperture and a data aperture on the first portion, the securement device comprising:

an elongated member having a first end and a second end opposite the first end;

a first bracket having a first connection portion and a first back portion with an extension extending from the back portion, the first connection portion receiving the first end of the elongated member when assembled; and a second bracket having a second connection portion and a second back portion, the second connection portion receiving the second end of the elongated member when assembled;

wherein in a locked configuration, the extension is inserted within one of the power aperture and the data aperture, the elongated member extends across the item to connect the first bracket to the second bracket, the second back portion of the second bracket is engaged with the second portion of the item;

and wherein in the locked configuration the extension is prevented from substantial withdrawal from the power aperture or the data aperture due to the elongated member preventing substantial separation of the first bracket from the second bracket.

2. The securement device of claim 1, wherein:

the second end of the elongated member comprises a locking groove extending circumferentially thereabout, the locking groove configured to receive a lock in secured engagement.

3. The securement device of claim 1, wherein:

the second end of the elongated member comprises a shackle aperture, the shackle aperture configured to receive a shackle of a lock in secured engagement.

4. The securement device of claim 1, wherein the extension is nonconductive.

5. The securement device of claim 4, wherein the extension is an insert which is configured to be removably inserted into a registration aperture in the first bracket.

6. The securement device of claim 1, wherein the extension is an insert which is configured to be removably inserted into a registration aperture in the first bracket.

7. The securement device of claim 1, wherein the first bracket, the second bracket, and the elongated member are separable.

8. The securement device of claim 1, wherein the first bracket and the elongated member are inseparable.

9. The securement device of claim 1, wherein the first bracket and the elongated member are monolithically constructed.

10. A system comprising:

an item to be secured, the item having a perimeter having a first portion and a second portion opposite the first portion, the item having at least one of a power aperture and a data aperture;

a securement device comprising an elongated member extending in the longitudinal direction and having a first end and a second end opposite the first end, a first bracket having a first connection portion and a first back portion with an extension extending from the back portion, the first connection portion receiving the first end of the elongated member when assembled, and a second bracket having a second connection portion and a second back portion, the second connection portion receiving the second end of the elongated member when assembled; and a lock engaging the second end of the elongated member and holding the second bracket in the locked position;

wherein in a locked configuration, the extension is inserted within one of the power aperture and the data aperture, the elongated member extends across the item to connect the first bracket to the second bracket, the second back portion of the second bracket is engaged with the second portion of the item;

and wherein in the locked configuration the extension is prevented from substantial withdrawal from the power aperture or the data aperture due to the elongated member preventing substantial separation of the first bracket from the second bracket.

11. The system of claim 10, wherein the second bracket comprises an aperture on the second connection portion receiving, with at least a slip fit, the second end of the elongated member.

12. The system of claim 11, wherein the lock engages the second end of the elongated member and resists retraction of the second end out of the aperture.

13. The system of claim 12, wherein the second end of the elongated member comprises a locking groove extending circumferentially thereabout.

14. The system of claim 13, wherein the lock engages the locking groove.

15. The system of claim 12, wherein the second end of the elongated member comprises a shackle aperture.

16. The system of claim 15, wherein the lock comprises a shackle extending through the shackle aperture.

* * * * *